US005916109A

United States Patent [19]

Espinosa

[11] Patent Number: 5,916,109

[45] Date of Patent: Jun. 29, 1999

[54] FEED MEANS FOR BOTTOM WRAP ¾ WRAP APPARATUS

[75] Inventor: Medardo Espinosa, Hialeah, Fla.

[73] Assignee: Quipp Systems, Inc., Miami, Fla.

[21] Appl. No.: 08/874,969

[22] Filed: Jun. 13, 1997

Related U.S. Application Data

[60] Provisional application No. 60/020,086, Jun. 13, 1996.

[51] Int. Cl.[6] ..... B65B 11/08; B65B 27/08; B65B 41/16

[52] U.S. Cl. ..... 53/397; 53/399; 53/141; 53/228; 53/389.4; 53/466; 53/586

[58] Field of Search ..... 53/399, 141, 176, 53/228, 449, 466, 586, 580, 389.4, 389.3, 389.5, 397; 226/88, 91, 35

[56] References Cited

U.S. PATENT DOCUMENTS

| | | | |
|---|---|---|---|
| 3,540,182 | 11/1970 | Price | 53/397 |
| 3,710,533 | 1/1973 | Burns | 53/389.4 X |
| 3,967,767 | 7/1976 | Seragnoli | 53/389.4 X |
| 4,914,891 | 4/1990 | Suolahti | 53/389.1 X |
| 5,009,055 | 4/1991 | Simmons | 53/580 X |
| 5,103,617 | 4/1992 | Sjogren et al. | 53/389.4 X |

*Primary Examiner*—Linda Johnson
*Attorney, Agent, or Firm*—Louis Weinstein

[57] ABSTRACT

Bottom wrap/three-quarter wrap apparatus having an automatic web feeder for safely advancing a web fed from a supply roll to a main web feeder. The web free end is inserted between a pair of rollers, one being driven by a motor and the other being free-wheelingly mounted. The free-wheeling roller swings about a pivot shaft. A cylinder normally maintains the free-wheeling roller displaced from the drive roller. The insertion of the web past the nip formed by the initial feed rollers is detected by a proximity sensor to pull the free-wheeling roller toward the motor-driven roller pinching the web therebetween. A small motor drives the driven roller, moving the web upwardly and into a nip formed by a main feed roller pair. The small motor is then turned off and the main feed rollers advance one length of the web and a cutter cuts the advanced length, completing one cycle of operation, after which the bottom wrap/three-quarter wrap apparatus is placed under control of a bundle feeder. The main feed roller pair are displaced from one another when the web passes between creasing rollers. When a predetermined length of web has been advanced to the creasing rollers a cutter cylinder moves a blade mounting plate in the cutting direction.

23 Claims, 7 Drawing Sheets

FEED MEANS FOR BOTTOM WRAP ¾ WRAP APPARATUS

This application claims the benefit of U.S. Provisional Application No. 60/020,086, filed Jun. 13, 1996.

FIELD OF THE INVENTION

The present invention relates to bottom wrap/three-quarter wrap apparatus for feeding a given length of a protective sheet to a wrap station preparatory to a bundle tieing operation and more particularly to bottom wrap/three-quarter wrap apparatus having novel feed means for providing a simplified and safe technique for insertion of a web into the apparatus.

BACKGROUND OF THE INVENTION

The present invention constitutes an improvement over the apparatus and method taught, for example, by U.S. Pat. No. 5,103,617 issued Apr. 14, 1992 and assigned to the Assignee of the present invention. As described therein, the apparatus wraps signature bundles through the employment of feed rollers which feed a web from a supply roll of indeterminate length to rollers for shaping the web to form a bend or crease which renders the web self-supporting as it is moved in an upward vertical direction so as to form a "wall" lying within the path of an approaching bundle.

A conveyor conveys the bundle at a speed sufficient to cause the bundle to crash into the "wall" causing the sheet to lose its ability to be self-supporting and thereby collapse about the bundle. The bundle is moved past the position at which the web is fed upwardly through the conveying surface causing the sheet to wrap about at least two contiguous surfaces, including at least the front surface and bottom surface of the bundle. The bundle continues moving in the conveying direction and is delivered to an outfeed location typically provided with equipment for tieing the bundle.

The bottom/three-quarter wrap apparatus, which is described in detail in U.S. Pat. No. 5,103,617, which description is incorporated herein by reference thereto, is designed to accommodate a large supply roll containing a web of indeterminate length which is fed and cut into predetermined lengths, each of which serves as a bottom or ¾ wrap sheet.

When a supply roll is depleted, a new supply roll is placed upon the supply roll spindle and the free end of the web must then be manually inserted between a pair of non-driven rollers and into the nip of the main feed rollers. This is extremely difficult and tedious to accomplish, necessitating the lifting and/or removal of certain components in order to insert the free end of the web into the nip formed by the main feed rollers. In addition, the feeding of the web when the main motor drive is off is difficult, so that many users operate the main motor during insertion of a new supply web, which presents a potential for injury of the operator.

Such a technique, which is utilized to assure that the web is fed into the nip between the main feed rollers necessitates that the machine be turned on, placing the operator in great potential danger by attempting to insert the web into the nip of the main feed rollers with the apparatus in fill operation.

The cutting assembly in the wrapping apparatus of U.S. Pat. No. 5,103,617 utilizes a cutting blade, which is arranged to one side of the upwardly moving web, and cooperates with the top of one of the web guides arranged on the opposite side of the web, and serves as a cutting anvil. The blade is moved in a substantially horizontal direction through the web, and along the cooperating surface of the anvil. The prior art design necessitates that the blade be positioned with a high degree of precision relative to the cooperating surface of the anvil to achieve proper cutting. This critical adjustment is thrown off when the wrap apparatus is moved even slightly, necessitating frequent readjustment in order to assure dean, proper cutting.

BRIEF DESCRIPTION OF THE INVENTION

The above problems and disadvantages of the prior art design are overcome by the novel feeding and cutting assemblies of the present invention to yield a much more effective and less sensitive wrapping apparatus.

The feeding apparatus, which overcomes the disadvantages of the prior art is characterized by comprising a pair of initial feed rollers arranged on opposite sides of the path of movement of the web. A first one of the rollers is driven by a small, compact motor. The remaining roller is swingably mounted and is movable under the control of a cylinder between a first position in which the swingably mounted roller is pressed against the motor driven roller to form an initial feed nip, and a second position displaced from the motor driven roller.

When the wrapping apparatus is turned "on" and a web is not present, the cylinder moves the swingably mounted roller to the displaced position, responsive to a proximity sensor, enabling the operator to pass a free end of the web upwardly through the gap between the motor driven and swingably mounted rollers. The proximity sensor detects the presence of the free end of the web as it moves upwardly past the gap between the pair of initial feed rollers and in the vicinity of the sensor, to operate the cylinder to resiliently urge the swingably mounted roller toward the motor driven roller thereby restoring the driving nip. After the driving nip is restored, the operator may depress the "START" button (see FIG. 3) located on a control panel (not shown). The small, compact motor 40 will be energized and drive the web upwardly through the nip region between the main feed rollers, which are normally displaced from one another and are brought together only when feeding a web upward toward rollers 22–26. The main motor for the apparatus, which operates continuously, advances the web to the nip between the creasing rollers when a second cylinder drives the main feed rollers toward engagement (a predetermined time after the small motor is turned on), and when a predetermined length of web is advanced, the web is cut by the cutting assembly completing a full cycle in readiness for operation.

The cutting assembly is characterized by comprising a mounting plate, which is arranged to move a cutting blade mounted thereon between a cutting position and a displaced position.

Clamping means are resiliently mounted upon the blade mounting plate, and are positioned to clamp the web between the clamping assembly and a guide plate to further cooperate with the web feeding and creasing rollers to maintain the web taut immediately prior to the cutting blade engaging and cutting the web. A top edge of the guide plate against which the clamping means is urged serves as a stationary anvil for the cutting blade. By maintaining the web taut, the need for a tight, critical tolerance in the spacing between the anvil and the blade is eliminated. The use of the clamping means permits the main feed rollers to be displaced from one another as soon as the web is fed between the creasing rollers to prevent build up of the web behind the cutting web, thereby assuring smooth, continuous feeding of the web during each repeated cycle of operation.

The mounting of the clamping means and blade upon a common mounting plate further simplifies the clamping and cutting operations, which are performed under control of a common cylinder.

OBJECTS OF THE INVENTION

It is therefore one object of the present invention to provide a novel method and apparatus for insertion of a web of indeterminate length into a main feed mechanism of a bundle wrapping apparatus in a safe and easy manner.

Another object of the present invention is to provide method and apparatus for insertion of a new supply web into a web feeding apparatus and which permits insertion while the web feeding apparatus continues to operate.

Still another object of the present invention is to provide a novel method and apparatus for inserting a free end of the web of indeterminate length into an initial feeding mechanism which utilizes a small, compact motor for automatically advancing the web from the initial feeding mechanism to the main feeding mechanism of a bundle wrapping apparatus.

Still another object of the present invention is to provide novel method and apparatus for insertion of a free end of a web of indeterminate length into the main feed mechanism of a bundle wrapping apparatus employing a small, compact motor for driving a first initial feeding roller and a cylinder for urging a cooperating initial feed mechanism roller toward the motor driven roller to advance the web into the driving nip of the main feed mechanism responsive to insertion of the free end of the web into a gap between the motor driven roller and the cooperating roller by a proximity sensor.

BRIEF DESCRIPTION OF THE FIGURES

The above as well as other objects of the present invention will become apparent when reading the accompanying description and drawings in which.

DETAILED DESCRIPTION OF THE INVENTION AND PREFERRED EMBODIMENTS THEREOF

Figure 1A:
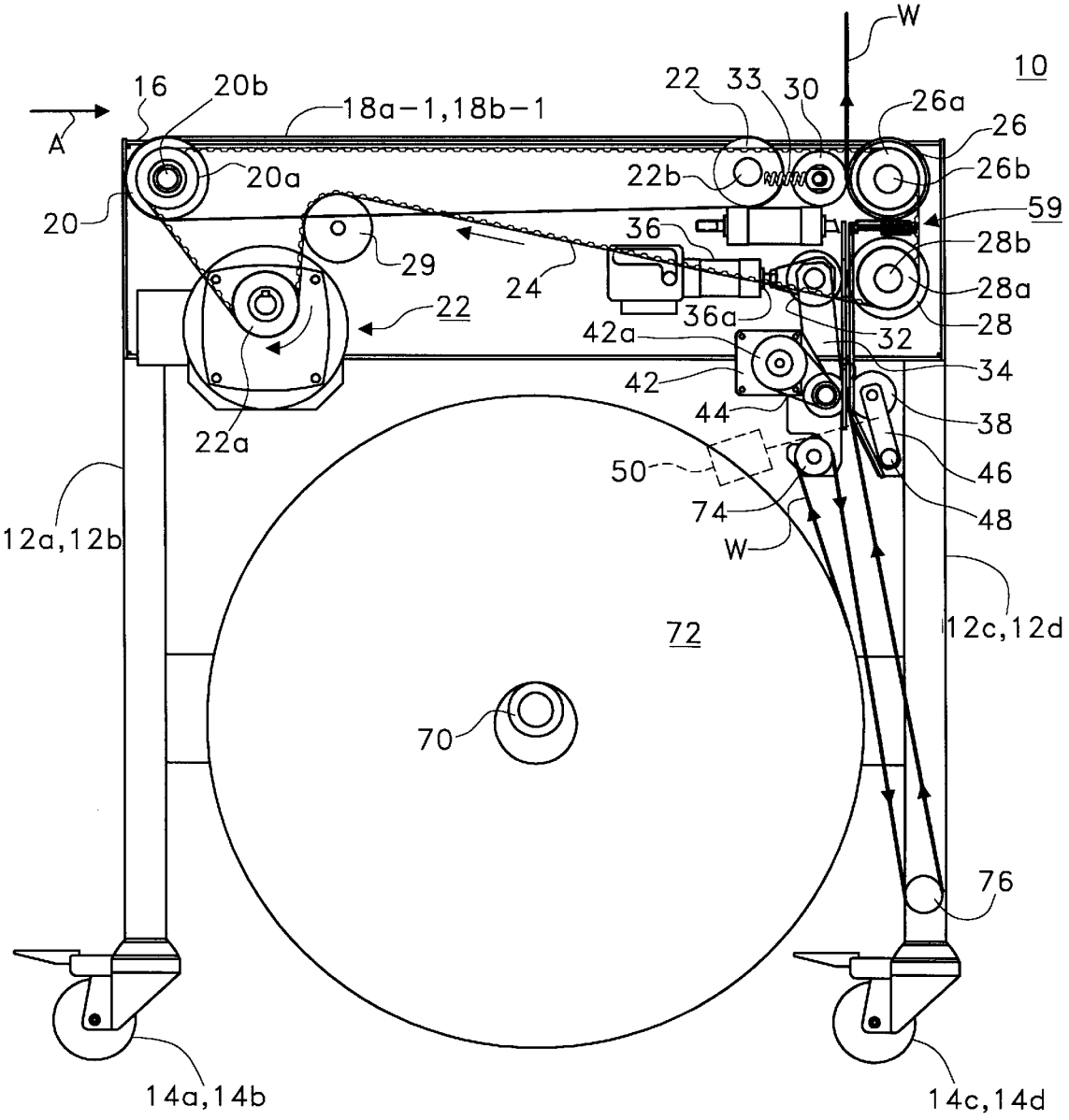
FIG. 1*a* shows an elevation view of a wrapping apparatus designed in accordance with the principles of the present invention.

Making reference to FIGS. 1*a*–1*d*, there is shown therein a wrapping apparatus 10 comprised of four (4) supporting legs 12*a*, 12*b*, 12*c* and 12*d* (only two (2) of which are shown in FIG. 1*a*), each leg having a caster for rollingly supporting the wrapping apparatus 10 upon a floor or other surface, such as the floor of a region in which newspaper bundles are formed and advanced to the wrapping apparatus 10.

Legs 12*a*–12*d* support a table comprised of an upper surface 16 for conveying bundles which enter the left side of wrapping apparatus 10 and move toward the right. A pair of closed-loop conveyor belts 18*a*, 18*b* have an upper run portion 18*a*1, 18*b*-1 extending just above the table surface 16 for conveying bundles in the direction of arrow A as they move onto surface 16. The conveyor belts, such as, for example, conveyor belt 18*a*, extends about rollers 20 and 22. The conveyor belts 18*a*, 18*b* are driven by a motor 22 having a pulley 22*a* driving a timing belt 24 entrained about: pulley 20*a* mounted on a common shaft with roller 20, pulley 26*a* mounted upon a common shaft 26*b* with roller 26, pulley 28*a* mounted on a common shaft 28*b* with roller 28, and tension roller 30, provided to maintain the timing belt 24 under proper tension.

Motor 22 drives pulley 22*a* clockwise, (in FIG. 1*a*) which in turn drives each of the pulleys 20*a*, 26*a* and 28*a* clockwise. Roller 26 cooperates with a plurality of rollers 30, which are resiliently urged toward roller 26 by springs 32, to positively drive a web W therebetween upwardly as shown in FIG. 1*a*.

Rollers 30 have associated therewith pairs of tapered members 31, 31 (to be more fully described) while roller 26 is provided with a pair of annular grooves 26*c*, 26*c*.

Annular grooves 26*c*, 26*c* cooperate with the members 31, 31 to form creases in an upwardly fed web W moving between rollers 26 and 30, which creases stiffen the web and maintain the web in an upright position to form a vertical "wall", which a bundle moving along conveyor belts 18*a*, 18*b* "crashes" into, causing the upright web to collapse about the bundle in the manner shown, for example, in FIG. 5*b* of U.S. Pat. No. 5,103,617, to provide a three-quarter wrap.

The roller 26 forms a plurality of feed nips with each of the ball-bearing-type rollers 30, which are mounted on shaft 31*c*. The ends of shaft 3 1*c* are reduced in diameter and are inserted into a pair of bushings 31*d* placed at opposite ends of shaft 31*c* to receive the shaft ends of reduced diameter.

Figure 1B:
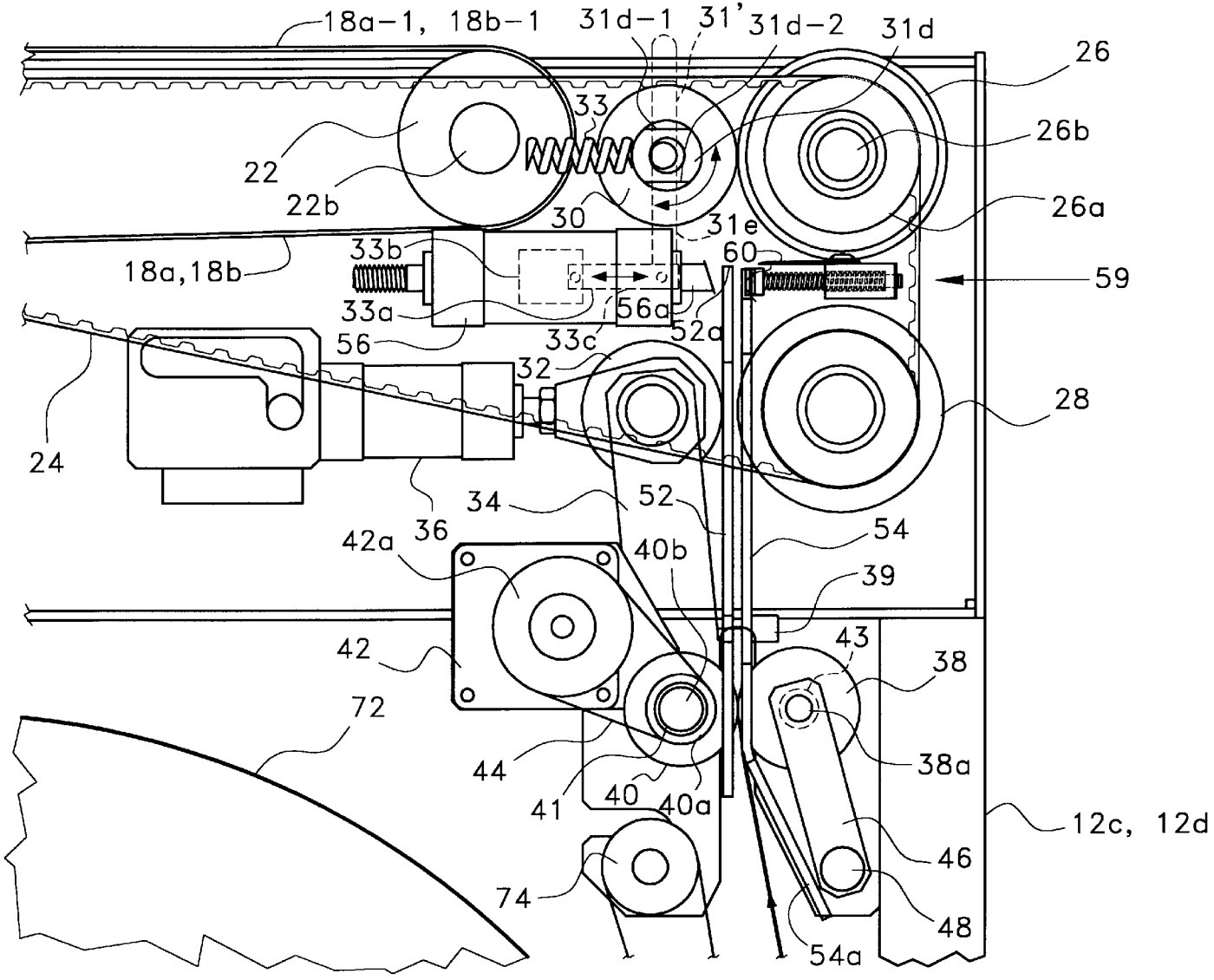
FIG. 1*b* shows an enlarged elevational view of a portion of the bundle wrapping apparatus of FIG. 1*a*.
Figure 1C:
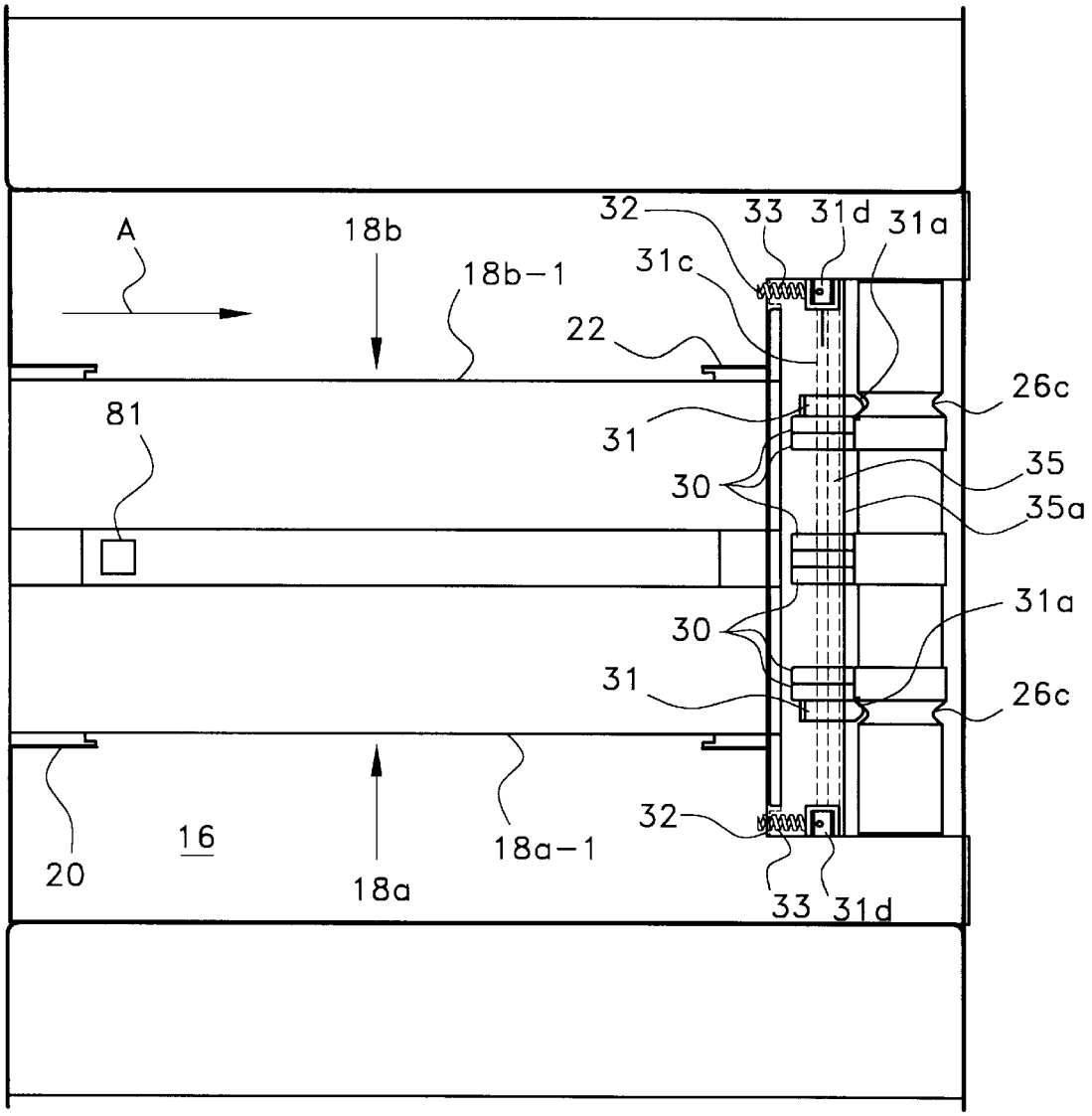
FIG. 1*c* shows a top view thereof and FIG. 1*d* shows a side elevational view thereof looking in the direction of the right-hand side of the wrapping apparatus.
Figure 1D:
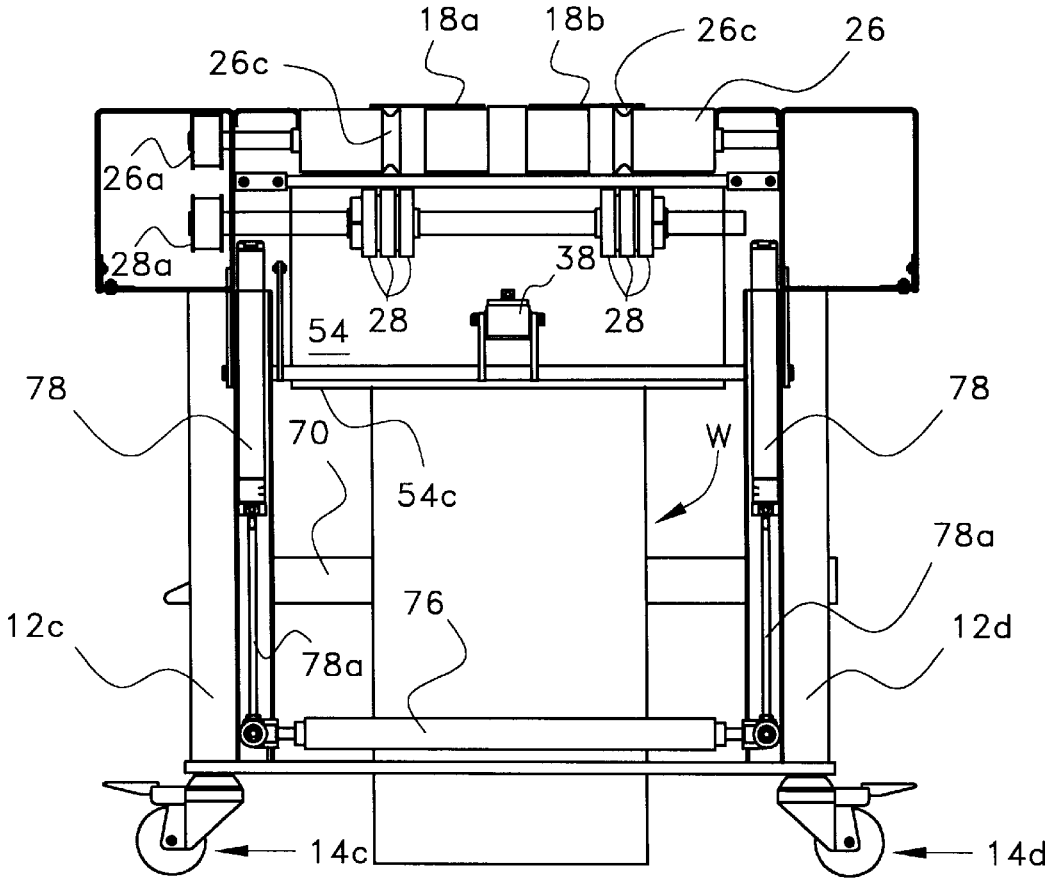

The bushings 31*d* are each provided with horizontally aligned flats 31*d*-1 and 31*d*-2 (FIGS. 1*a* and 1*b*). The bushings 31*d* are each arranged to be slidably mounted within slots in the machine frame (not shown), on opposite sides of the shaft 31*c*. Springs 33 urge the bushings 31*c* to the right toward roller 26. The projections 31, 31 are provided with openings through which shaft 31*c* extends. Threaded members (not shown) secure each of the projections 31, 31 to shaft 31*c*.

Handle 31*e* (FIG. 1*b*) is joined to one end of shaft 31*c* and is pivotally coupled to the free end of a piston rod 33*a* of cylinder 33*b* through an intermediate link 33*c*. Cylinder 33*b* rotates shaft 31*c* either clockwise or counterclockwise through a quarter-turn to move the tapered projections between a solid-line position (FIG. 1*c*) where they are substantially horizontally aligned and cooperate with grooves 26*c*, 26*c* in roller 26 to "crease" the web, or a vertical position 31' (FIG. 1*b*) where the tapered ends lie just beneath a thin cover plate 35 which is positioned above rollers 30 and has a right-hand edge 35*a* which extends downwardly and is provided with cut-away portions (not shown) to permit movement of the tapered projections and rotation of rollers 30 without interference.

Cover plate 35 prevents the bundles moving along surface 16 from engaging rollers 30, which rotate counterclockwise, to prevent the bundles as well as the apparatus from being damaged.

The cover plate 35 also prevents the tapered projections from coming into engagement with the moving bundles when in the position 31'.

The movable tapered projections enable the apparatus 10 to be used as either a bottom wrap or three-quarter (¾) wrap device.

A damper/cutter assembly 59 is arranged immediately beneath the roller 26, and between rollers 26 and 28 and is operated by a pair of cylinders 56 (only one being shown for purposes of simplicity) to move the blade 60 in the cutter assembly, as well as the damping means 92, in a horizontal direction to momentarily damp the web against plate 52 and then cut the web W as will be more fully described.

The damping means cooperates with a left-hand, elongated guide member 52 as will be more fully described. The blade 60 moves past an upper end 52*a* of guide plate 52, which serves as an anvil for the cutting blade 60, as will be more fully described hereinbelow.

Another driving nip is formed by roller 28 and cooperating roller 32. Roller 32 is mounted upon a pair arms 34, which swing about a common shaft 40*b*. Cylinder 36 selectively moves the roller 32 into and out of engagement with roller 28, rollers 28 and 32 forming a second driving nip, which will be referred to hereinbelow as the main driving nip.

Positioned below the rollers 32 and 28 is still another driving nip comprised of a roller 38 and roller 40, serving as an initial driving nip employed to insert a fresh web supply roll.

A pair of arms 46 swingably mount roller 38 about a common shaft 48. A cylinder 50, shown in FIG. 1*a* in dotted fashion, for simplicity, moves the roller 38 into and out of engagement with cooperating roller 40. Roller 40 is mounted upon shaft 40*b*, and has an integral pulley 40*a*. A small, compact motor 42 having a pulley 42*a* rotates motor driven pulley 40 by means of a pair of O-rings 44 entrained about pulleys 42*a* and 40*a*.

A second guide plate 54 cooperates with the first mentioned guide plate 52 to guide the web W upward and through the driving nips formed by rollers 38–40, 28–32 and 26–30, respectively. A proximity sensor 39 (FIG. 1*b*) is mounted upon guide member 54 at a position just above the nip formed by rollers 38–40 and below the drive nip of rollers 28 and 32, and, in one preferred embodiment, is comprised of a combination light source and light sensor. A reflective member is positioned along the inside right-hand surface of guide plate 52. Light from the light source (such as an LED) is reflected off the reflection surface of the reflective member and is picked up by the light detector, in the absence of a web. When a web passes upwardly between guide plates 52 and 54, the light path is broken, indicating that a web has been moved upwardly between plates 52 and 54 in the region of proximity sensor 39.

The manner in which a supply roll is replenished without turning off the wrapping apparatus 10 will now be described:

Motor 22 runs constantly and does not have to be turned off during the time that a new supply roll is provided.

When a supply roll is depleted, a new supply roll is placed upon the spindle 70, and is aligned so that the web occupies the position shown in FIG. 1*a*. The free end of the web initially extends upwardly and is then entrained about roller 74, and extends downwardly and is entrained about the roller 76, and thereafter is pulled diagonally upwardly.

A bottom portion 54*a* of guide plate 54 is bent at an angle to serve as a guide means for facilitating insertion of a free end of a new web into apparatus 10.

In the absence of a web, detected by sensor 39, cylinder 50 (FIG. 1*a*) is operated to rotate roller 38 clockwise about shaft 48 to displace roller 38 from roller 40, enabling the free end of the web to be fed upwardly and through the guide path defined by the spaced parallel guide plates 52 and 54.

Figure 3:
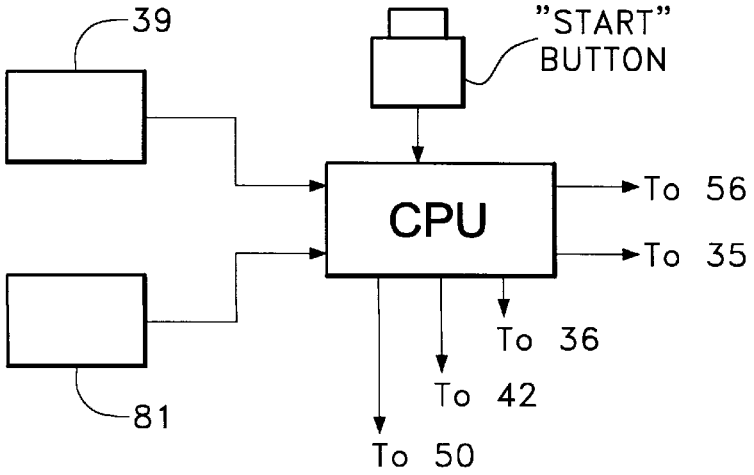
FIG. 3 is a block diagram showing a control for the apparatus of FIG. 1*a*.

The signal from sensor 39 is transmitted to a central processor CPU (FIG. 3) when the free end of the web moves upwardly past sensor 39, causing cylinder 50 to operate to move roller 38 to form a driving nip with roller 40. At this time, the web W is now between rollers 38 and 40.

The gap between plates 52 and 54 is sufficiently small enough to prevent the fingers of an operator from being inserted into the nip between rollers 38 and 39, and yet large enough to easily feed the free end of the web upward between plates 52, 54.

The operator is alerted to the fact that the web is held by rollers 38, 40 by virtue of the fact that the free end of the web does not fall downwardly.

The operator then depresses the "START" button, which in turn causes the CPU to turn motor 42 "ON" causing the web to feed upwardly. Although motor 22 is on, and remains on throughout the insertion operation, the CPU operates cylinder 36 to maintain roller 32 displaced from roller 28 so that no feeding of the web by rollers 28, 32 occurs at this time. A predetermined time interval after sensor 39 has turned on motor 42 (sufficient to feed the web W upwardly to move between rollers 28 and 32), cylinder 36 is operated to provide a driving nip between rollers 28 and 32, driving the web upwardly. After a second predetermined time interval, cylinder 56 is operated to perform a cutting operation.

Motor 42 is turned off after a time interval sufficient to assure that the web has been fed between rollers 28 and 32.

Rollers 38 and 40 are maintained in engagement with web W even after motor 42 is turned off. An over-running clutch 41 is provided between shaft 40*b* and roller 40. A second over-running clutch 43 is provided between roller 38 and shaft 38*a*. These one-way clutches permit rollers 40 and 43 to rotate counterclockwise and clockwise respectively, being rotated in this manner by the upward feeding of web W by the main feed rollers 28–32. In the event that the machine is turned off for any reason and when the feeding of the web is halted, the one-way clutches 41 and 43 prevent rollers 40 and 38 from respectively being rotated clockwise and counterclockwise, even in the event that roller 32 is displaced from roller 28, thereby preventing the web from moving downwardly to avoid the necessity for an additional feeding operation. The web feeding arrangement permits insertion of a web in a safe and easy manner, even though motor 22 is turned on. The web need be fed only a slight distance above the nip between rollers 38 and 40 so as to be detected by sensor 39. In addition, the width of the web guideway formed by plates 52 and 54 is sufficiently narrow as was set forth above, to prevent the fingers of an operator from being inserted therein, providing further safety protection.

The use of the compact motor and initial feeding means comprised of rollers 38 and 40 greatly simplifies the insertion of a new web supply roll, and further avoids the need for turning the equipment off during the loading process.

Appropriate tension of the web is maintained by the pneumatic cylinders 78, which cause the roller 76 to maintain the web reasonably taut and in the manner shown in the figures as being entrained about rollers 74 and 76 before entering into the web guide-way formed by plates 52 and 54. The one-way clutch 43, 41 prevent reverse (i.e. downward) feeding of the web even in the presence of the tension applied to the web by roller 76.

The manner in which the wrapping apparatus operates is substantially identical to that described in U.S. Pat. No. 5,103,617, and only a brief description will be set forth herein, for purposes of simplicity:

Bundles of signatures, typically delivered from a signature stacker (not shown for purposes of simplicity) are delivered to the left-hand, i.e. input, end of the wrapping apparatus 10, and moved onto the table surface 16 where they are conveyed to the right, as shown by arrow A, by the upper runs 18*a*-1, 18*b*-1 of conveyor belts 18*a*, 18*b*. A sensor 81 (FIG. 1*c*) detects the leading edge of a bundle as it is moved along the conveyor belts, and causes the CPU to operate cylinder 36 to form a driving nip between rollers 28 and 32 for driving the web W upwardly. The web is fed between rollers 26 and 30, and is creased at two locations by means of the tapered ends of members 31, 31 and the cooperating grooves 26*b*, 26*b*.

The CPU operates cylinder 36 to displace roller 32 from roller 28 at a predetermined timed interval, which is sufficient to assure that the web has entered into the driving nip between roller 26 and rollers 30. After another predetermined time interval, the CPU operates cylinder 56 to cause the blade 60 to be moved (i.e. "pulled") toward the left in order to cut a predetermined length of web for use as a three-quarter wrap or bottom wrap.

In view of the fact that the web is not held at a position beneath cutting blade 60, due to the fact that roller 32 has been displaced from roller 28, cutting of the web by conventional means is extremely difficult and further required a highly precise location of the cutting blade 60 relative to the upper end 52*a* of guide plate 50. It was thus extremely important to provide an extremely tight tolerance in the close spacing between the blade 60 and the end surface 52*a* of plate 52, which surface serves as the anvil for the cutting blade.

In order to assure that a good, clean cut is obtained, the present invention provides an assembly 59, which serves as both the clamping and cutting means whereby the clamping means temporarily, and just prior to the cutting operation, maintains the web taut enabling cutting to be performed "on the fly" (i.e. when the web is moving upwardly), and further eliminating the need for an extremely tight tolerance in the precision spacing between the cutting blade and the anvil surface.

Figure 2A:
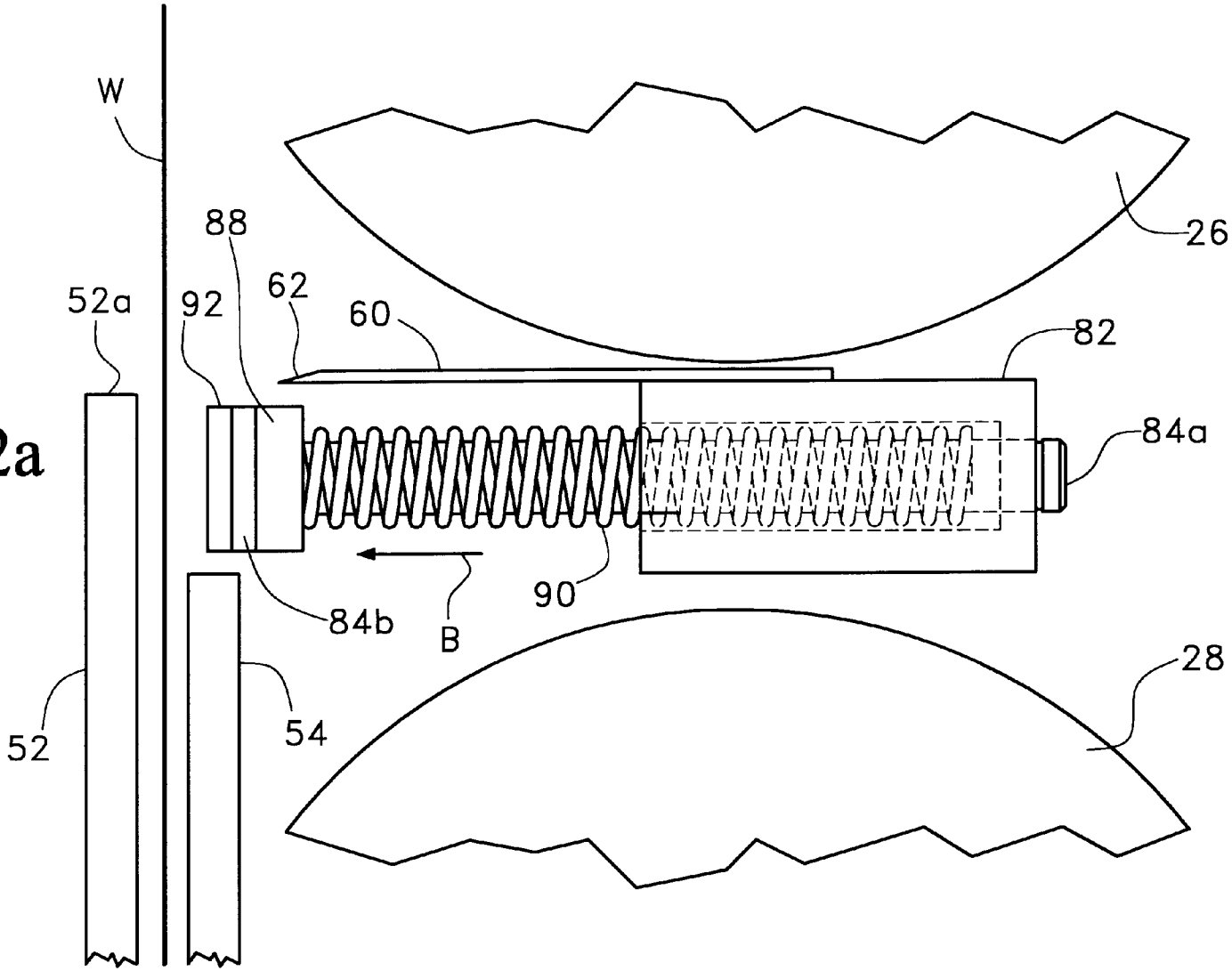
FIGS. 2*a*, 2*b* and 2*c* respectively show enlarged side, top and top views of the cutter/damper of FIG. 1*a*.
Figure 2B:
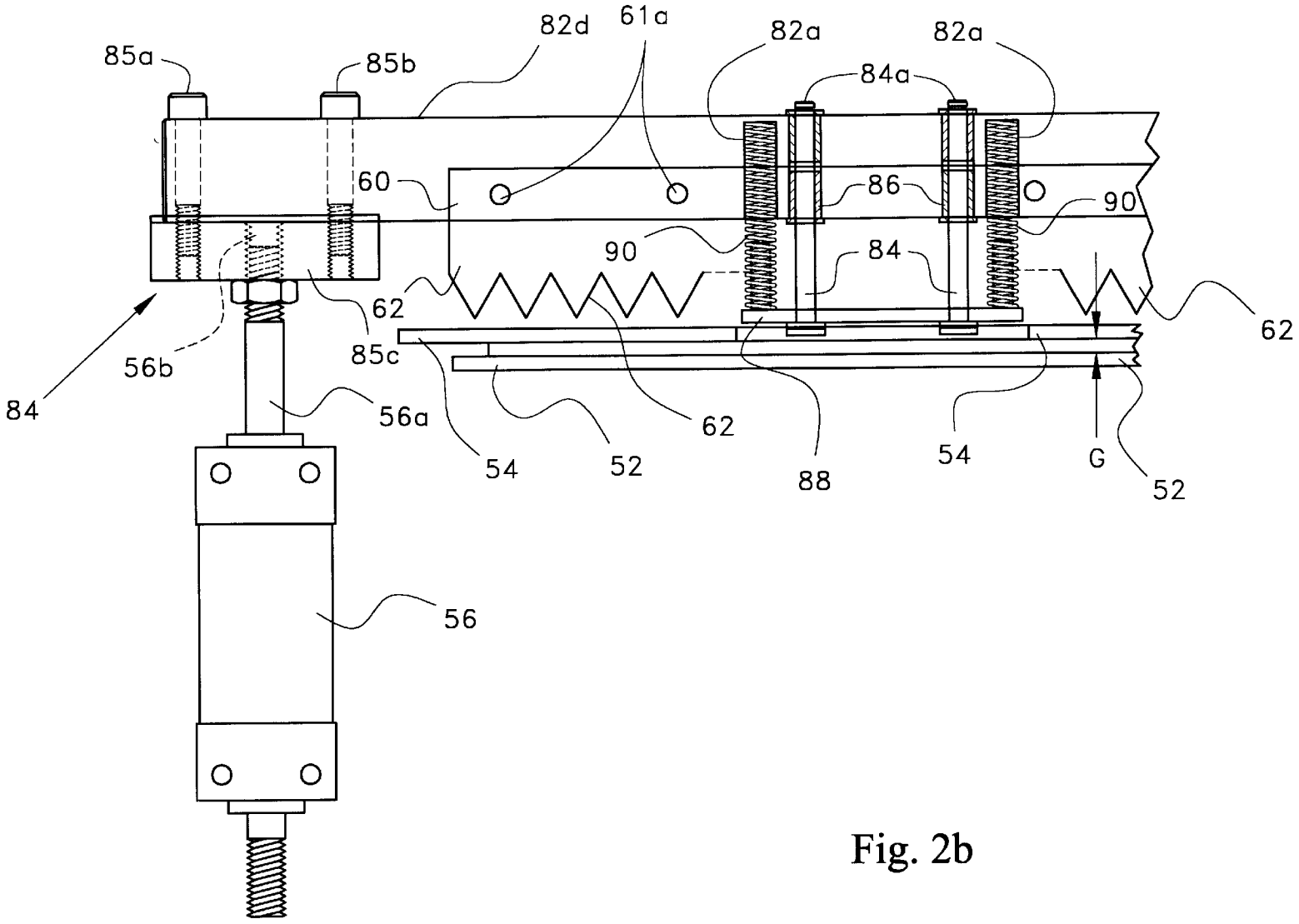
Figure 2C:
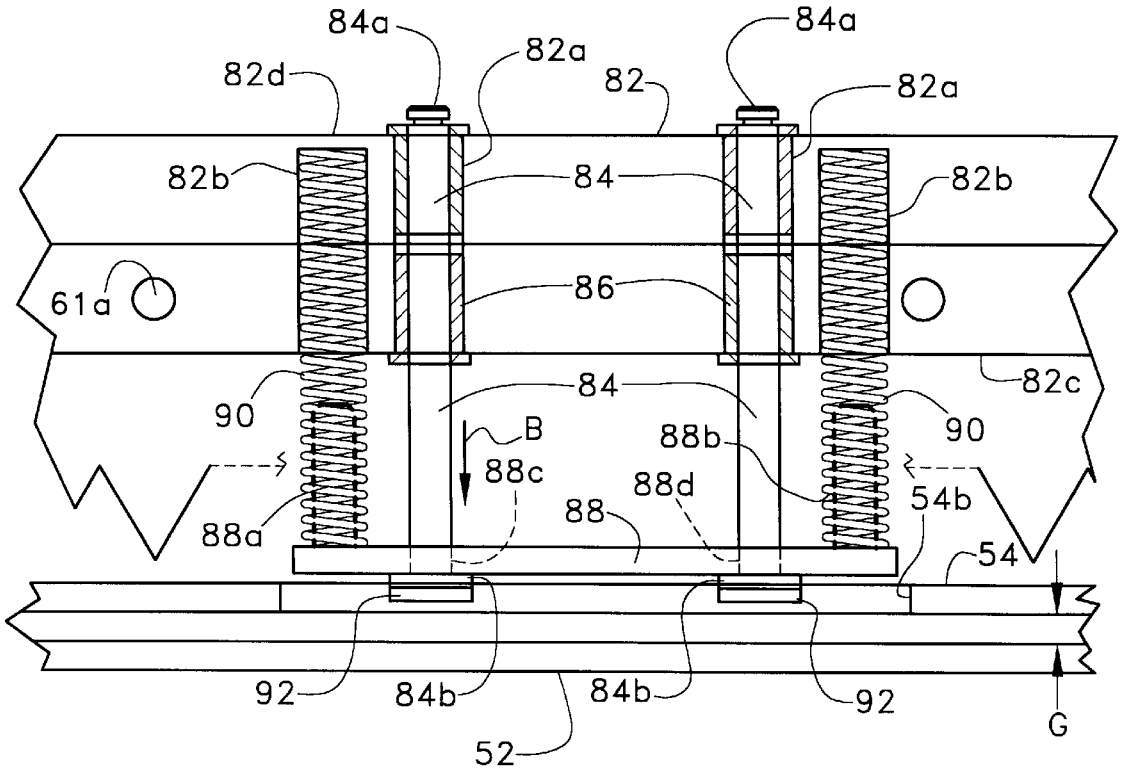

FIGS. 2*a*–2*c* show the cutter/damper of FIG. 1*a* in greater detail. The cutter/damper 59 is comprised of a mounting member 82 arranged to be reciprocated along a path parallel to a horizontal plane by means of cylinders 56 whose piston rods 56*a* are each joined to one end of the mounting member 82 by a clamping assembly 84 including fasteners 85*a*, 85*b* and plate 85*c*, which threadedly receives the threaded end 56*b* of piston rod 56*a*. Only one cylinder 56 is shown in FIG. 2*b* for purposes of simplicity.

Elongated blade 60 is arranged upon the top surface of member 82 and is secured to member 82 by suitable fasteners 61*a*.

The blade has a sawtooth cutting edge 62, which extends toward the path of the moving web W. The elongated member 82 is provided with a plurality of openings 82*a*, each receiving an elongated rod 84. A bearing 86 is arranged in each opening 82*a* and has a low coefficient of sliding friction to assure smooth, easy sliding motion of the rods 84 relative to member 82. The ends of each rod are provided with a head 84*a* having an annular flange which extends over and beyond the inner diameter of the openings 82*a* and the bearings 86 to limit the movement of rods 84 in the direction shown by arrow B.

Mounting member 82 is further provided with a plurality of bores 82*b*, which are open at their ends along side 82*c* of member 82 and which terminate short of the rear side 82*d*. An elongated helical spring 90 is inserted into each bore 82*b*. An elongated plate 88 is provided with a pair of integral rod shaped projections 88*a*, 88*b*, which extend into the free ends of helical springs 90. Plate 88 is provided with a pair of openings 88*c*, 88*d* for receiving the free ends of rods 84. The ends of rod 84 are provided with integral head portions 84*b* having high friction, resilient compressible disk-shaped pads 92 mounted thereon.

Although it is preferred that pads 90 be used to clamp the web, the pads may be eliminated and the ends of the rods 84 may be knurled or roughened or treated with a coating of a material which provides a high friction surface for engaging the web. Also, additional spring loaded rods 84 may be provided, if desired.

The cutter/clamping assembly operates in the following manner:

FIGS. 2*b* and 2*c* show guide plates 52 and 54, which provide a gap space G therebetween forming a guideway for the web as was described hereinabove. Guide plate 54 is provided with a cut away portion 54*b* providing clearance for the clamping disks 92, heads 84*b* and plate 88.

Springs 90, 90 normally urge plate 88 in the direction shown by arrow B, shown in FIG. 2*c*, which serves to urge rods 84 in the same direction, further movement in the direction of arrow B being limited by the head portions 84*a* of rods 84.

During the time that the web is being fed upwardly, the cutter/clamper assembly 59 is maintained in the solid-line position shown in FIGS. 2*a*, 2*b* and 2*c*.

When a leading edge of a bundle is detected as arriving at a particular location along the conveyor surface of wrapping apparatus 10, the main feeding means is operated to provide a driving nip urging the web upwardly toward the feeding nip between the roller 26 and bearing rings 30.

A predetermined time interval after cylinder 36 is operated to create the feed nip (controlled by the CPU), which period of time is sufficient to assure that the web has entered the nip between rollers 26 and 30, cylinder 36 is operated to displace roller 32 from roller 28. The positive feeding between the roller bearing rollers 30 and roller 26 assures the upward movement of the web W therebetween. Presuming that the apparatus 10 is operating as a three-quarter (¾) wrap, the tapered projections 31 extend into the annular grooves in roller 26 to shape the paper so as to form "creases" therein which stiffens the web and causes the web to stand upright as it is being fed upwardly. After a predetermined time, the leading end of the bundle "crashes" into (i.e. "collides with") the upright, stiffened web material, causing the web to collapse, and thereby wrap around the bundle in the manner shown, for example, in the aforementioned U.S. Pat. No. 5,103,617.

At a predetermined time, cylinder 56 is operated by the CPU (see FIG. 3) causing the mounting member 82 to move to the left as shown in FIG. 1*a* to initiate a cutting operation.

As can dearly be seen from the figures, and especially FIGS. 2*a* and 2*c*, the damping pads 92 are first to engage the web W and damp it against a confronting surface portion of guide member 52 just prior to the cutting edge 62 of blade 60 reaching the web.

Thus, although the roller 32 has been displaced from roller 28, the web is temporarily damped between the pads 92 and surface of guide member 52 before the cutting blade engages the web W. Since cutting is done "on the fly" i.e. while the web is being positively fed by roller 26 and bearing rollers 30, the damping of the web between plate 52 and pads 92 maintains the web taut just prior to cutting. Immediately after the web is damped between members 92 and 52, the blade cuts through the web. By maintaining the web taut in this manner, the web is cleanly and neatly cut by the cutting edge of the blade. As soon as the blade cuts through the web, the taut condition of the web is immediately released so that, even though the web is temporarily clamped between pads 92 and guide plate 52, the web does not proceed upwardly since no drive means located upstream of the clamping pads 92 is active at this time. The short timing interval between the damping and the cutting of the web assures that the web will not be stretched so as to be torn before the cutting operation can take place.

The displacement of roller 32 from roller 28 prevents any build up of the web either behind the cutting blade and/or behind the region between the feed rollers 26 and 30, which could result in a jam condition.

The rapid movement of the pads 92 against the web W and the surface of guide plate 52 are cushioned by the springs 90, preventing the guide plate and pads from being damaged, and further eliminating the need for a high tolerance adjustment to assure proper damping between pads 92 and guide plate 52.

A predetermined and very short time interval after cylinder 56 is actuated to move member 82 to the left, and a time interval sufficient to assure that complete cutting has occurred, the CPU (FIG. 3) reverses the drive applied to cylinder 56 to return the cutter/damper 59 to its initial position, which it occupies preparatory to a subsequent cutting operation.

The damping means assures sufficient tautness of the web which guarantees a smooth cutting operation, totally eliminating the extremely dose spacing required between blade 60 and the top of guide plate 52 in the prior art design.

As was mentioned hereinabove, the automatic feeding and the damping/cutting operations of the present invention may be utilized with the wrapping machine when operating in a first mode where the web is creased to stand upright in order to provide a three quarter wrap, as well as a second mode wherein the creasing members 31 are displaced from roller 26 to simply provide a bottom wrap for signature bundles.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A method for advancing a web to a nip formed by a pair of main feed rollers powered by a main motor and utilizing a normally deenergized auxiliary motor, a pair of input rollers normally displaced from one another and driven by the auxiliary motor and a sensor located on a downstream side of said input rollers for providing a first signal when a web reaches the sensor, comprising the steps of:

(a) providing a gap between said input rollers;

(b) inserting a web into said gap;

(c) employing said sensor to detect when said web moves adjacent to said sensor thereby indicating that the web has entered the gap;

(d) moving the input rollers toward engagement with one another when the sensor indicates that a web has entered said gap;

(e) energizing said auxiliary motor a first given time interval after completion of step (d); and (f) deenergizing said auxiliary motor after a given time interval sufficient to assure that the web is fed to said nip.

2. A method for advancing a web to a nip formed by a pair of main feed rollers powered by a normally energized main motor and utilizing a normally deenergized auxiliary motor, a pair of input rollers normally displaced from one another and a sensor for providing a signal when a web reaches a given position comprising the steps of:

(a) providing a gap between said input rollers;

(b) inserting a web into said gap;

(c) employing said sensor to detect when said web moves adjacent to said sensor thereby indicating that the web has entered the gap;

(d) moving the input rollers toward engagement with one another when the sensor indicates that a web has moved into said gap;

(e) energizing said auxiliary motor a first given time after completion of step (d) to assure that the web has been fed to the nip;

(f) deenergizing said auxiliary motor after a given time interval.

3. The method of claim 1 further comprising:

employing the sensor to detect an absence of a web at the location of said sensor and separating the input rollers when the sensor detects an absence of the web at the location of said sensor to prepare the input rollers for insertion of a new web.

4. Apparatus for advancing a web to a nip formed by a pair of main feed rollers, driven by a main motor, comprising:

a pair of input rollers;

said input rollers being movable between an engaged and a disengaged position;

an auxiliary motor for driving said input rollers;

a sensor for generating an output responsive to presence or in absence of a web at a given position;

operating means for moving said input rollers to said engaged position responsive to an output of said sensor in a presence of a web;

said operating means including means for energizing said auxiliary motor when said input rollers have moved to said engaged position; and means for deenergizing said auxiliary motor after an interval sufficient to feed said web to said nip.

5. The apparatus of claim 4 wherein said main motor is normally energized to enable driving of said web by said main feed rollers upon movement of the main feed rollers to the engaged position.

6. The apparatus of claim 4 wherein said main motor is normally energized to enable feeding of a web by the main feed rollers upon their engagement.

7. The apparatus of claim 4 further comprising means for guiding a web from said input rollers to said main feed rollers, said guide means preventing an operator from coming into contact with the input rollers.

8. The apparatus of claim 4 further comprising means for moving the main feed rollers toward engagement a predetermined time after energization of the auxiliary motor sufficient to assure movement of a web driven by the input rollers to enter into a gap between the main feed rollers.

9. Apparatus for feeding a web into a feed nip formed by a pair of main feed rollers driven by a main motor to feed a web to a web feeding and creasing assembly, comprising:

a pair of input rollers for advancing a web to the main feed rollers and an auxiliary motor for rotating said input rollers and being energized independently of the main motor to insert a web into the feed nip formed by the main feed rollers, said auxiliary motor being energized for a time interval sufficient to enable a portion of the web being fed by said input rollers to enter said feed nip.

10. The apparatus of claim 9 further comprising means for deenergizing the auxiliary motor at an end of said time interval.

11. The apparatus of claim 10 further comprising means for separating said input rollers when said sensor detects that no web is present in a nip of said input rollers.

12. The apparatus of claim 11 further comprising means separating said main feed rollers when said input rollers are separated.

13. The apparatus of claim 9 further comprising mean for preventing the input rollers from rotating in a direction opposite a feed direction.

14. A device for feeding a free end of a web into a nip formed by a first pair of main feed rollers driven by a main motor for feeding a web in a given direction comprising:

a pair of initial feed rollers including a first roller and a second movably mounted roller;

a first drive assembly for selectively moving said second roller between a first position engaging said first roller and a second position displaced from said first roller;

a proximity sensor for sensing the presence or absence of a web;

said drive assembly moving the second roller to said second position when said sensor detects an absence of a web to facilitate insertion of a free end of a web between said first and second rollers and moving said second roller to said first position when said sensor detects a presence of a web;

an auxiliary motor independent of said main motor being activated to rotate said first roller when said second roller is moved to said first position;

one of said first pair of main feed rollers being driven by said main motor and one another of said first pair of main feed rollers being movably mounted; and means for normally retaining said movably mounted main feed roller displaced from said one of said pair of main feed rollers.

15. The device of claim 14 further comprising:

a second drive assembly for moving said second main feed roller from a position normally displaced from said first main feed roller after a time interval the web has entered between said first and second feed rollers.

16. The device of claim 14 wherein said first motor is a small, compact motor.

17. The device of claim 14 wherein said first motor is smaller than said second motor.

18. The device of claim 14 wherein at least one of said first and second initial feed rollers is provided with a one-way clutch to prevent a web in said initial feed nip from moving in a direction opposite said given direction.

19. The device of claim 18 wherein tension means is provided for maintaining a given tension in a web extending between a web supply roll and said initial feed nip.

20. The device of claim 18 herein said main feed rollers move a web through said main feed nip in an upward direction.

21. Apparatus for wrapping a bundle comprising:

means for conveying a signature bundle along a substantially horizontal path and toward and through a wrapping station;

means arranged beneath said path for feeding an elongated wrapping sheet in a generally upward direction so as to cross said path;

means for causing the wrapping sheet to wrap about a portion of the bundle;

said means for feeding being comprised of a first pair of main feed rollers for feeding the wrapping sheet in said upward direction comprising:

a second pair of initial feed rollers positioned upstream of said pair of main feed rollers and including a first roller and a second mounted roller;

a first drive assembly for moving said second roller between a first position for providing an initial feed nip with said first roller and a second position displaced from said first roller;

a proximity sensor positioned in a sensing region located between said first and second pairs of rollers for sensing a presence of a wrapping sheet passing a sensing location adjacent to said sensor;

said drive assembly moving the second roller to said second position when said sensor detects an absence of a wrapping sheet in said sensing region to facilitate insertion of a free end of a wrapping sheet between said first and second rollers and moving said second roller to said first position when said sensor detects a web in said sensing region;

a motor being activated to rotate said first roller when said second roller is moved to said first position;

one of said first pair of main feed rollers being driven by a second motor and a second one of said first pair of main feed rollers being movably mounted; and means for normally retaining said movably mounted main feed roller displaced from said first one of said pair of main feed rollers.

22. Apparatus for wrapping a bundle comprising:

means for conveying a signature bundle along a substantially horizontal path and toward and through a wrapping station;

feeding means comprising a pair of cooperating rollers arranged beneath said path and having a feeding nip for feeding an elongated wrapping sheet in a generally upward direction so as to cross said path;

shaping means selectively engaging said wrapping sheet for shaping the wrapping sheet as it is being fed upwardly from said shaping means so that the wrapping sheet is sufficiently rigid and self-supporting to feed an end of the sheet to a point above the bundle;

means for causing the wrapping sheet to wrap about a portion of the bundle; and means for selectively disengaging said shaping means from said web while said web continues to be fed by said feeding means to provide a bottom wrap.

23. The apparatus of claim 9 wherein said auxiliary motor is smaller than said main motor.

* * * * *

UNITED STATES PATENT AND TRADEMARK OFFICE

CERTIFICATE OF CORRECTION

PATENT NO : 5,916,109
DATED : June 29, 1999
INVENTOR(S) : Medardo Espinosa

It is certified that error appears in the above-identified patent and that said Letters Patent is hereby corrected as shown below:

at column 2, line 8 after the word "assure" delete "dean" and insert therefor --clean--;

at column 3, line 51 after the word "cutter/" delete "damper" and insert therefor --clamper--;

at column 4, line 12 after the word "roller" delete "30" and insert therefor --29--;

at column 5, line 11 after the word "the" delete "damping" and insert therefore --clamper--;

at column 7, line 45 after "cutter/" delete "damper" and insert therefore --clamper--;

at column 7, line 46 after "cutter/" delete "damper" and insert therefore --clamper--;

at column 9, line 37 after the word "the" delete "damping" and insert therefore --clamper--;

Claim 1 - Column 9, line 66 after the word "that" delete "a" and insert therefore --the--;

Claim 2 - Column 10, line 19 after the word "that" delete "a" and insert therefore --the--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*